US006674087B2

(12) United States Patent
Cadwalader et al.

(10) Patent No.: US 6,674,087 B2
(45) Date of Patent: Jan. 6, 2004

(54) RADIATION ATTENUATION SYSTEM

(75) Inventors: John A. Cadwalader, Overland Park, KS (US); John Q. Zheng, Peat Tree City, GA (US)

(73) Assignees: Worldwide Innovations & Technologies, Inc., Overland Park, KS (US); Winpak Films Inc., Winnipeg (CA)

( * ) Notice: Subject to any disclaimer, the term of this patent is extended or adjusted under 35 U.S.C. 154(b) by 239 days.

(21) Appl. No.: 09/774,872

(22) Filed: Jan. 31, 2001

(65) Prior Publication Data

US 2002/0148980 A1 Oct. 17, 2002

(51) Int. Cl.[7] ..... G21F 3/00

(52) U.S. Cl. ..... 250/515.1; 250/519.1; 128/849

(58) Field of Search ..... 250/516.1, 519.1, 250/517.1, 515.1; 75/229; 428/220; 128/849

(56) References Cited

U.S. PATENT DOCUMENTS

| | | | | |
|---|---|---|---|---|
| 3,419,006 A | | 12/1968 | King | 128/268 |
| 3,514,607 A | | 5/1970 | Webster | 250/108 |
| 3,935,099 A | | 1/1976 | Weaver et al. | 210/43 |
| 4,286,170 A | | 8/1981 | Moti | 250/520 |
| 4,621,808 A | | 11/1986 | Orchard et al. | 272/119 |
| 4,670,658 A | * | 6/1987 | Myers | 250/519.1 |
| 4,938,233 A | * | 7/1990 | Orrison, Jr. | 128/849 |
| 5,247,182 A | * | 9/1993 | Servant et al. | 250/516.1 |
| 5,278,219 A | | 1/1994 | Lilley et al. | |
| 5,523,581 A | | 6/1996 | Cadwalader | |
| 5,525,408 A | | 6/1996 | Weir et al. | 428/220 |
| 5,548,125 A | | 8/1996 | Sandbank | |
| 6,048,379 A | | 4/2000 | Bray et al. | |
| 6,153,666 A | | 11/2000 | Lagace | 523/136 |

FOREIGN PATENT DOCUMENTS

FR 2 439 460 10/1978

OTHER PUBLICATIONS

International Search Report (Form PCT/ISA/210) for PCT/US02/05000 for Worldwide Innovations & Technologies, Inc., dated Jul. 11, 2002 (mailed Jul. 24, 2002), Authorized Officer: F. Jandl, 4 pages.

Promotional material titled Xenolite Radiation Protection Garments by DuPont Technology "Less Weight . . . Full Protection," Manufactured by Lite Tech, Inc., 18 Depot Street, Bridgeport, PA 19405, undated (3 sheets, 1 color).

Xenolite "No Lead" material (sample circa 2002).

* cited by examiner

*Primary Examiner*—John R. Lee
*Assistant Examiner*—Phillip Johnston
(74) *Attorney, Agent, or Firm*—Foley & Lardner

(57) ABSTRACT

A radiation attenuation system is disclosed. The system includes a polymeric resin comprising a web. The system also includes a radiation attenuation material dispersed at least partially in the web. The system has a radiation transmission attenuation factor of at least about 10% of a primary 100 kVp x-ray beam. A method of making a radiation attenuation system including a radiation attenuation material dispersed at least partially in a polymeric resin is also disclosed. The method includes extruding the radiation attenuation material and the polymeric resin thereby forming an extrusion. The method also includes forming the extrusion into a web. The web has a radiation transmission attenuation factor of at least about 10% of a primary 100 kVp x-ray beam. A shield for the attenuation of radiation is also disclosed.

42 Claims, 12 Drawing Sheets

RADIATION ATTENUATION SYSTEM

FIELD

The present disclosure relates to a radiation attenuation system. More particularly, the present disclosure relates to a radiation shield.

BACKGROUND

A lead protective barrier or shield to attenuate radiation is generally known. Such shield is typically fabricated from a lead vinyl web loaded with lead. However, such shield has several disadvantages because the shield is of only average pliability, retains permanent creases during normal handling, and is not capable of draping smoothly over regions of a patient to be shrouded. Further such shield is not generally disposable, or is the subject of disposal only at great inconvenience and cost (due to the lead content).

Accordingly, it would be advantageous to provide a radiation attenuation system that is relatively flexible and compliant, and which provides a relatively high degree of comfort to the user. It would further be advantageous to provide a radiation attenuation system that provides attenuation of radiation for health care personnel working in an x-ray environment. It would also be advantageous to provide a radiation attenuation system that is disposable. It would also be advantageous to provide a radiation attenuation system that is sterilizible before use. It would also be advantageous to provide a radiation attenuation system that includes a moisture barrier. It would be desirable to provide for a radiation attenuation system having one or more of these or other advantageous features.

SUMMARY

An exemplary embodiment relates to a system for the attenuation of radiation. The system includes a polymeric resin comprising a web. The system also includes a radiation attenuation material dispersed at least partially in the web. The system has a radiation transmission attenuation factor of at least about 10% of a primary 100 kVp x-ray beam.

Another exemplary embodiment relates to a shield for the attenuation of radiation. The shield includes a sheet comprising a plurality of layers. The shield also includes a radiation attenuation material dispersed at least partially in the plurality of layers. The sheet has a radiation transmission attenuation factor of at least about 10% of a primary 100 kVp x-ray beam.

Another exemplary embodiment relates to a method of making a radiation attenuation system. The system includes a radiation attenuation material dispersed at least partially in a polymeric resin. The method includes extruding the radiation attenuation material and the polymeric resin thereby forming an extrusion. The method also includes forming the extrusion into a web. The web has a radiation transmission attenuation factor of at least about 10% of a primary 100 kVp x-ray beam.

DETAILED DESCRIPTION OF PREFERRED AND OTHER EXEMPLARY EMBODIMENTS

Figure 1:
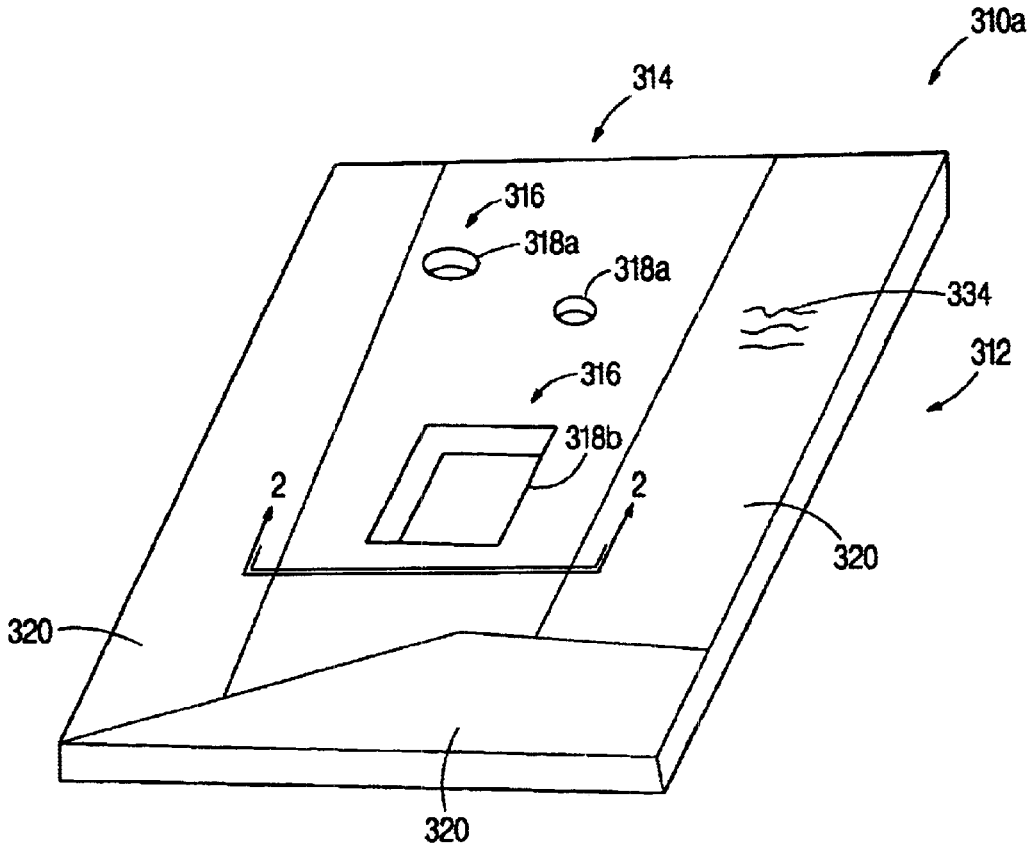
FIG. 1 is a perspective view of a radiation attenuation system according to an exemplary embodiment.

FIG. 1 shows a radiation attenuation system 310*a* providing a radiation drape, pad or shield 312. Shield 312 may be useful in blocking, attenuating and/or reflecting radiation, and assisting in the protection of a worker (e.g. a physician or technologist during a medical procedure) in tasks. Shield 312 may attenuate radiation provided by a variety of natural or man-made sources over a wide range of the electromagnetic spectrum from wavelengths of $1.0\times10^{-15}$ meters (e.g. cosmic rays) to $1.0\times10^{6}$ meters (e.g. radiation from AC power lines) including visible and invisible light, and may find incidental uses at relatively low or high frequency extremes (including gamma rays). Shield 312 may also selectively isolate regions for direction of radiation, and may selectively shroud or protect regions beyond the contours or margin of the zone of interest.

Shield 312 may include a radiation attenuation region (shown as a strip 314) for the attenuation of radiation. A fenestration area 316 of shield 312 provides access to an area of interest (e.g. patient) through an aperture (shown as a circular hole 318*a* and a parallelogram shaped hole 318*b*) for conducting various invasive procedures, such as the fluoroscopic guidance and/or manipulation of instruments during surgical procedures. Strip 314 may be at least partially surrounded by a panel (shown as a window 320) that is relatively clear or translucent for the viewing of objects (e.g. controls, instruments, etc.) beneath shield 312. Shield 312, strip 314, holes 318*a* and 318*b* and window 320 may be of a variety of shapes and sizes, which may be dictated at least in part by the particular application (e.g. angiography, femoral angiography, general biopsy, pacemaker implant, etc.). Indicia 334 for identification or personalization of shield 312 may be identified or written on shield 312.

Figure 2:
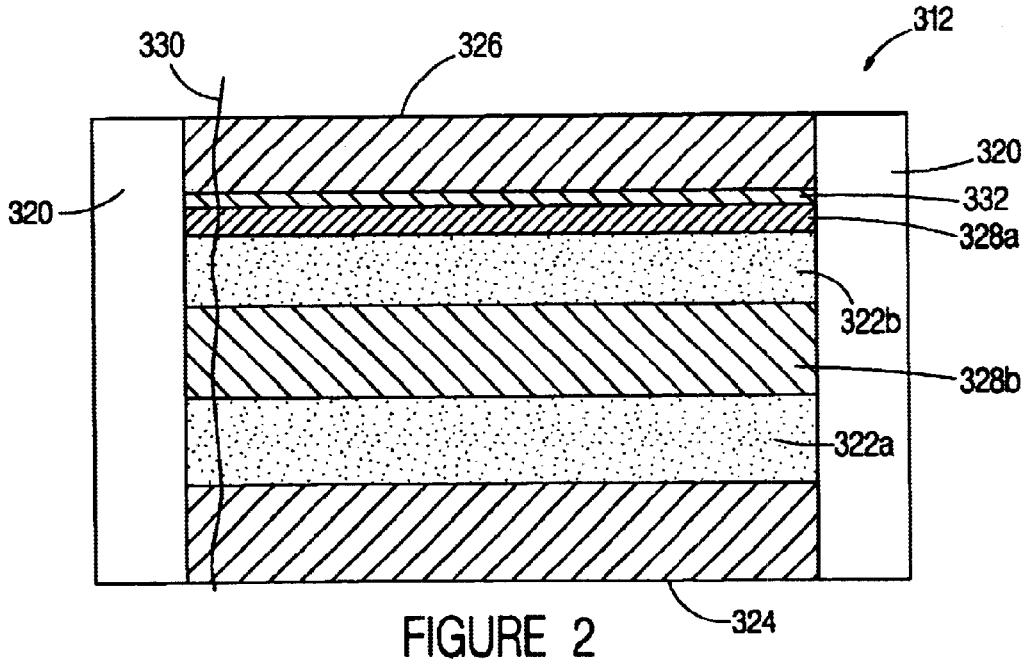
FIG. 2 is a cross-sectional view of the system of FIG. 1 along line 2—2 of FIG. 1.

FIG. 2 shows a cross-sectional view of shield 312. The attenuation of radiation is provided by at least a web 322*a* (e.g. matrix, sheet, film, polymer radiation attenuation material, etc.) of attenuation material or filler, such as barium sulfate powder, bismuth powder, or other attenuating materials/fillers compounded (e.g. mixed, blended, alloyed, etc.) with a polymeric carrier, and a web 322*b*. On one side of shield 312, web 322*a* may be attached to a cover 324 such as a fabric (e.g. soft carded polyester) for placement next to the area of interest (e.g. patient). Cover 324 provides some comfort to a user (e.g. patient) and assists in the retention of body heat. On another side of shield 312, an absorbent layer 326 (e.g. polyester) may be coupled to web 322*b* for maintaining fluid control (e.g. block blood from seeping onto the patient during a surgical procedure). Absorbent layer 326 may include fibers (e.g. wet-laid, spunlaced, etc.) bonded or woven to a reinforcing layer 332 having a network frame or scrim 372 (see FIG. 5).

Absorbent layer 326 may be attached to a relatively liquid impervious layer 328*a* such as plastic, polyethylene, etc. Impervious layer 328*a* may assist in inhibiting the transmission of fluid from absorbent layer 326 to cover 324 (i.e. separates fluid from the patient). An optional relatively liquid impervious layer 328*b* may be disposed between web 322*a* and 322*b*. A fastener 330 (e.g. adhesive, stitching, spot weld, ultrasonic weld, hot melt, laminate, etc.) may attach the layers of shield 312 (i.e. absorbent layer 326, impervious layers 328*a* and 328*b*, webs 322*a* and 322*b*, and cover 324) to each other.

Figure 3:
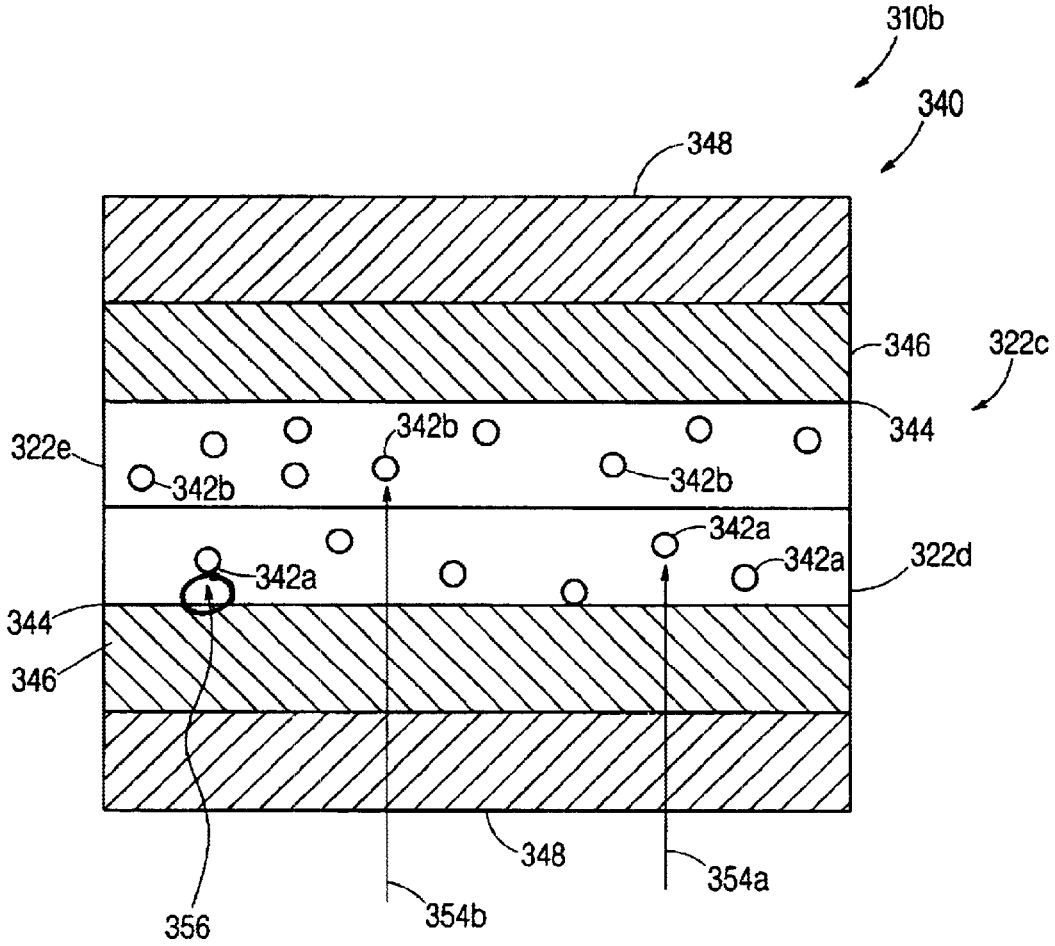
FIG. 3 is a sectional view of a radiation attenuation system according to an alternative embodiment.

FIG. 3 shows a radiation attenuation system 310*b* having a radiation barrier 340. Barrier 340 includes a layer or web 322*c* including a monolayer (i.e. at least one layer) shown as a primary attenuation layer 322*d* of a relatively flexible material (e.g. polymer resin). Barrier 340 may be charged with a radiation attenuation material such as metal powder (shown as a particle 342*a* and a particle 342*b*). Particle 342*a* is shown generally evenly distributed and dispersed within layer 322*d*.

A secondary attenuation layer 322*e* of web 322*c* is shown attached to layer 322*d* by a fastener (e.g. hot melt adhesion or laminate). Without intending to be limited to any particular theory, it is believed that multiple attenuation layers may increase the radiation attenuation factor of the radiation attenuation system. Two attenuation layers are shown in FIG. 3, and the radiation attenuation system may have multiple attenuation layers (e.g. 3, 6, 20 layers, etc.) according to alternative embodiments.

A tie layer 344 may attach attenuation layer 322*c* to a covering (shown as a skin 346). The tie layer may include: polyethylenes such as low density polyethylene (LDPE), linear low density polyethylene (LLDPE), very low density polyethylene, very low density polyethylene (VLDPE), medium density polyethylene (MDPE), high density polyethylene (HDPE) and metallocene polyethylene (MPE); ethylene copolymers such as ethylene vinyl acetate (EVA), ethylene methacrylate (EMA), ethylene ethylacrylate (EEA) and ethylene butyl acrylate (EBA); acid copolymers such as ethylene methacrylic acid and ethylene acrylic acid; lonomer including zinc and sodium SURLYN film (which may be made of synthetic thermoplastic resin for use in commercial and industrial wrapping) commercially available from E. I. du Pont de Nemours and Company of Wilmington, Del.; extrudable adhesive polymers such as BYNEL adhesive resins (which may be for industrial use) commercially available from E. I. du Pont de Nemours and Company of Wilmington, Del. (maleic anhydride copolymer); thermoplastic elastomers such as styrenic block copolymer, thermoplastic polyurethanes, polyolefin blends, elastomeric alloys, thermoplastic copolyesters and metallocene plastomer; and polypropylenes, etc.

Skin 346 may function as a partition or wall to separate attenuation layers 322*d* and 322*e* from a user. According to an alternative embodiment, the skin may be made from a material that is the same or different from the material of the attenuation layers, or from a material to enhance processability, softness or comfort for a user. According to another alternative embodiment, the skin may function as a heat-sealing layer. According to other alternative embodiments, the skin may be provided with a colorant (e.g. clear, blue, red, etc.). (The web is typically dark colored, due in part to the color of the attenuation material.) Skin 346 may be attached to a cover layer 348 such as a fabric. One or more of the layers of barrier 340 may be attached or coupled to each other with a fastener. According to other alternative embodiments, the fastener may be omitted. According to still other alternative embodiments, the cover and the absorbent layer may merely surround the web (e.g. as an envelope) and need not necessarily be attached to the web.

FIG. 3 also shows the radiation attenuation ability of barrier 340. A primary incident radiation beam 354*a* is shown having partially penetrated barrier-340. Beam 354*a* interacts with particle 342*a* in primary attenuation layer 322*d*, and is absorbed by particle 342*a*. Another primary beam 354*b* is shown having penetrated primary attenuation layer 322*d*, interacted with particle 342*b* in secondary attenuation layer 322*e*, and absorbed by particle 342*b*. A scattered radiation beam 356 is shown having penetrated primary attenuation layer 322*d* and absorbed by particle 342*a*. According to alternative embodiments, primary beams and scattered beams of incident radiation may be attenuated by additional multiple attenuation layers of the barrier or within a monolayer barrier.

Multiple layers of radiation attenuation system 310*b* may cause an increase in the thickness of web 322*c*, which suitably has a thickness of about 1–300 mil, suitably about 1–50 ml, suitably about 1–10 mil and more suitably about 5–8 mil. (Thus, the total weight of radiation attenuation system may be minimized.) The thickness of the web may also be determined in part by the desired radiation attenuation factor, and the weight and volume requirements of the attenuation material.

Figure 4B:
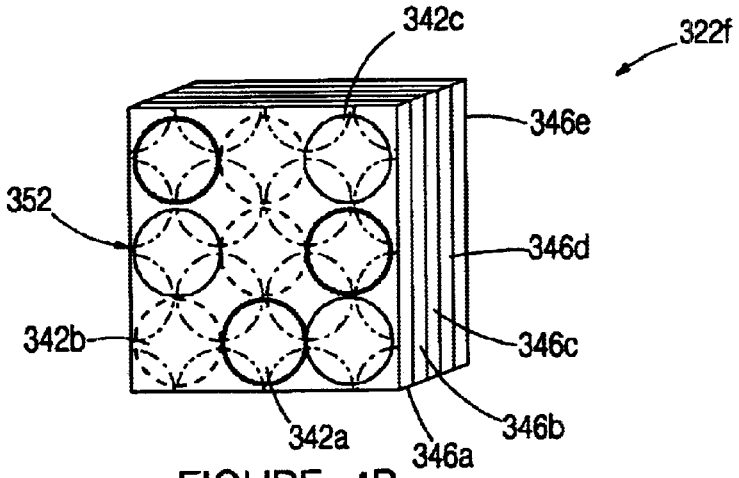
FIG. 4B is a fragmentary perspective view of the web of FIG. 4A showing an effective coverage area.
Figure 4A:
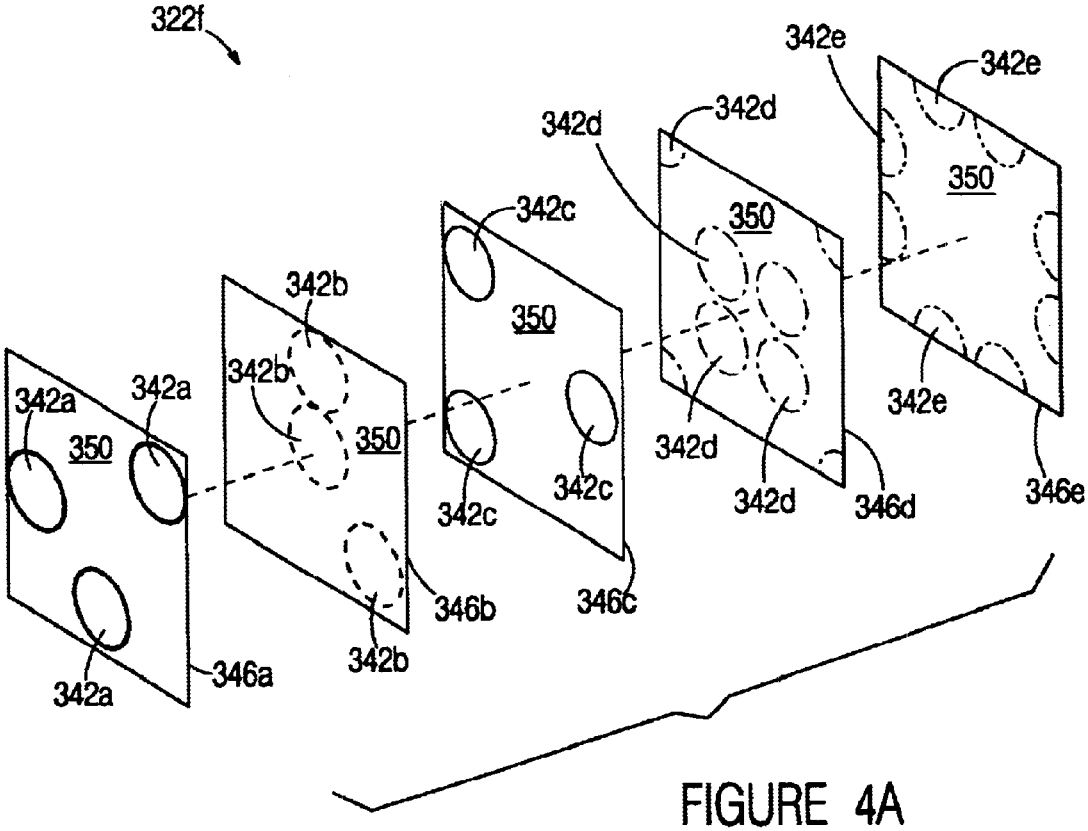
FIG. 4A is an exploded perspective view of a web according to an exemplary embodiment.

As shown in FIGS. 4A and 4B, the attenuation material is suitably distributed generally evenly in each of the attenuation layers of a web 322*f*. Particles 342*b* are distributed throughout an intermediate film 346*b* "sandwiched" or surrounded by a cover film 346*a* having particles 342*a*, and a base film 346*c* having particles 342*c*. Web 322*f* may also include layers or films 346*d* and 346*e*. Particles 342*a*, 342*b*, 342*c*, 342*d* and 342*e* are shown generally evenly dispersed on a dispersion face 350 of each of base film 346*a*, intermediate film 346*b*, cover film 346*c* and films 346*d* and 346*e*. On assembly of films 346*a*, 346*b*, 346*c*, 346*d* and 346*e* (e.g. as a monolayer laminate), particles 342*a*, 342*b*, 342*c*, 342*d* and 342*e* effectively cover the entire surface area of web 322*f* in an effective coverage area 352, such that substantially all incident radiation will be attenuated by web 322*f* (see FIG. 4B).

The degree of radiation transmission attenuation factor by the radiation attenuation system will depend in part on the specific application to which the radiation attenuation system is put. For example, for medical applications the radiation attenuation system may have a radiation transmission attenuation factor of a percent (%) greater than about 50%, suitably greater than about 90%, suitably greater than about 95%. For other applications, such as articles of clothing, a radiation transmission attenuation factor of a percent of about 10–50%, suitably 10–20% may be sufficient. Any radiation attenuation system may have radiation transmission attenuation greater than at least about a factor of a percent of about 10%, suitably about 10–98%, suitably greater than about 50% (with reference to a 100 kVp x-ray beam). The radiation attenuation system may also at least partially attenuate gamma rays, and may have a gamma ray attenuation fraction of at least about 10% of a 140 keV gamma radiation source.

The material of the web is generally light and flexible, to maximize workability for processing, bending, folding, rolling, shipping, etc. The web may be formable (e.g. deformable) or compliant, and relatively "stretchable" (e.g. elastic). The shape of the web may be determined in part by the material to which the web is bound. For example, the shape of the web could be relatively planar if bound to a wall, and the shape of the web could be generally curved if bound to a corrugated material. While the resin of the web may partially attenuate some radiation, greater quantities of flexible material in the web may increase flexibility and comfort, and decrease the likelihood of cracking. According to alternative embodiments, the web may be generally rigid and inflexible.

Suitable materials for the web include: polyethylenes such as low density polyethylene (LDPE), linear low density polyethylene (LLDPE), very low density polyethylene, very low density polyethylene (VLDPE), medium density polyethylene (MDPE), high density polyethylene (HDPE) and metallocene polyethylene (MPE); ethylene copolymers such as ethylene vinyl acetate (EVA), ethylene methacrylate (EMA), ethylene ethylacrylate (EEA) and ethylene butyl acrylate (EBA); acid copolymers such as ethylene methacrylic acid and ethylene acrylic acid; lonomer including zinc and sodium SURLYN film (which may be made of synthetic thermoplastic resin) for use in commercial and industrial wrapping commercially available from E. I. du Pont de Nemours and Company of Wilmington, Del.; extrudable adhesive polymers such as BYNEL adhesive resins which may be for industrial use) commercially available from E. I. du Pont de Nemours and Company of Wilmington, Del. (maleic anhydride copolymer); thermoplastic elastomers such as styrenic block copolymer, thermoplastic polyurethane, polyolefin blends, elastomeric alloys, thermoplastic copolyesters and metallocene plastomer; thermoplastic polyamide (nylon); and polypropylenes, etc. The web may also include synthetic materials such as polyolefins (such as, polypropylene and polybutene), polyesters (such as polyethylene, polyurethane terephthalate and polybutylene terephthalate), polyamides (such as nylon 6 and nylon 66), acrylonitriles, vinyl polymers and vinylidene polymers (such as polyvinyl chloride and polyvinylidene chloride), and modified polymers, alloys, and semi-synthetic materials such as acetate and polytetrafluoroethylene (PTE) fibers. The web may also include a thermoplastic elastomer (e.g. EPM, EPDM, styrene butadiene styrene or SBS, etc.) and others polymer.

The attenuation material in the web may assist in the attenuation of incident radiation. The amount of attenuation material may depend in part on the degree of flexibility desired in the web, and the degree of attenuation desired. According to a suitable embodiment, the weight of the attenuation material is greater than the weight of the polymeric resin (e.g. weight ratio), suitably by a ratio of about 10:1, suitably by a ratio of about 5:1, suitably by a ratio of about 2:1, suitably by a ratio of about 1:1. According to another suitable embodiment, the volume of the attenuation material may be less than the volume of the polymeric resin (e.g. volume ratio), suitably by a ratio of about 1:1, suitably by a ratio of about 1:3, suitably by a ratio of about 1:5. According to another suitable embodiment, the volume of the attenuation material may be greater than the volume of the polymeric resin, suitably by a ratio of at least about 10:1.

Particularly suitable radiation attenuation materials include barium and bismuth powders, and corresponding salts and oxides (e.g. $BaSO_4$). Other suitable attenuation materials include elements having an atomic number greater than about fifty (50) on the periodic table. Other suitable attenuation materials include barium, bismuth, iodine, tin, tungsten, uranium, zirconium and lead, their corresponding salts or oxides, and combinations thereof. According to a particularly suitable embodiment, the radiation attenuation material does not necessarily contain a significant amount of lead (e.g. essentially free of lead).

The size of the radiation attenuation material may in part affect its dispersion within the resin (i.e. relatively larger particles have relatively good dispersion). According to a suitable embodiment, the particles of the attenuation material have a diameter between about 840–10 micron meters (about−20 mesh to −1250 mesh), suitably between about 297–20 micron meters (about −50 mesh to −625 mesh), suitably between about 149–37 micron meters (about −50 mesh to −400 mesh), suitably between about 74–44 micron meters (about −200 mesh to −325 mesh). According to a particularly preferred embodiment, the barium powder is SPARWITE W-10HB high brightness barium sulfate commercially available from Mountain Minerals Co. Ltd. of Calgary, Alberta, Canada having a median particle diameter of about 1.9–2.1 microns. According to a particularly preferred embodiment, the bismuth powder is commercially available from ASARCO Incorporated of New York, N.Y.

Figure 5:
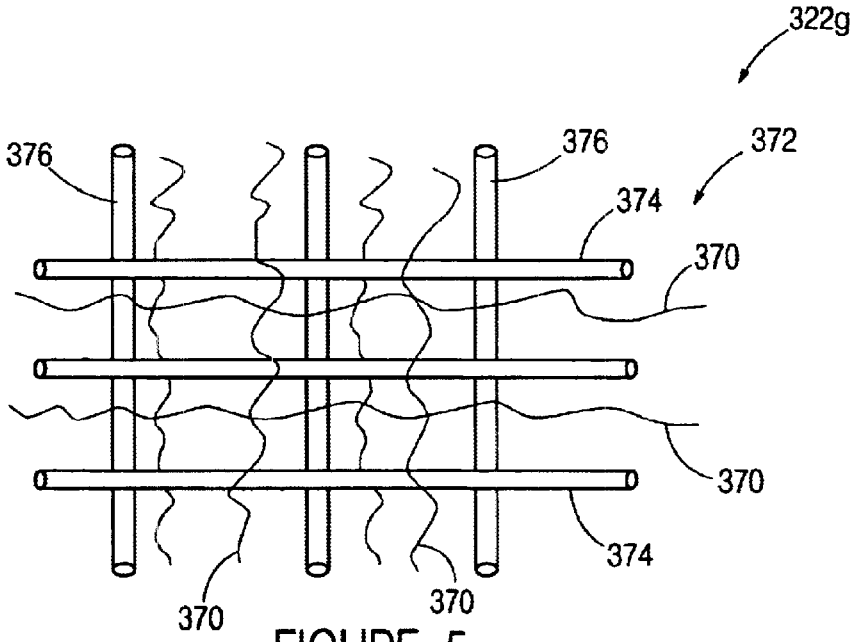
FIG. 5 is a perspective view of a web according to an alternative embodiment.

Referring to FIG. 5, a web 322*g* may be a "fabric" made from fibers 370 attached (e.g. by hydroentaglement or air laying) to a reinforcing network shown as a scrim 372 having horizontal members 374 interconnected with vertical members 376. The attenuation material may be impregnated in the fiber by a variety of techniques such as fiber spinning process. In the fiber spinning process, a pre-compounded blend is first prepared with relatively fine attenuation powder dispersed within the polymeric matrix (e.g. through a twin screw extrusion). The pre-compounded blend is than fed into an extruder for melt extrusion. The extrudates from the extruder may go through a filter and a "spinneret" to form the fiber.

Figure 6:
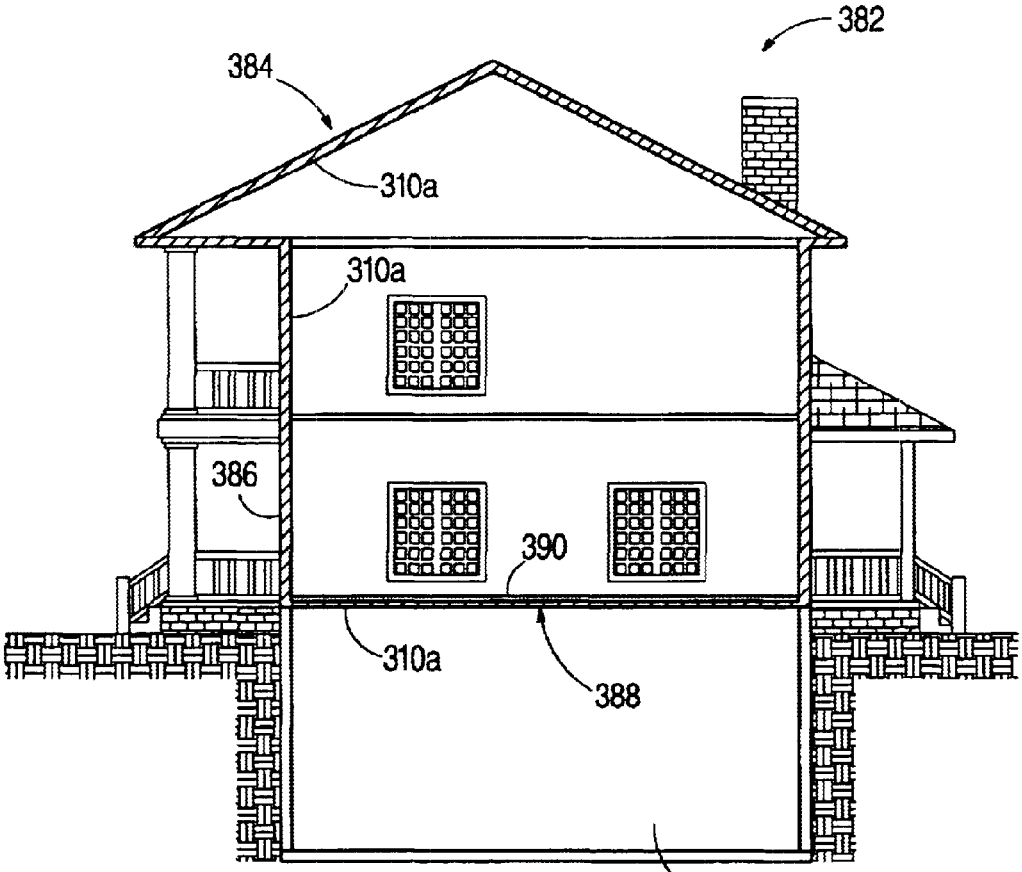
FIG. 6 is a schematic view of a shelter according to an exemplary embodiment.

The web of the radiation attenuation system, which includes a flexible resin and an attenuation material, may be used in a variety of applications. As shown in FIG. 6, radiation attenuation system 310*a* may be incorporated into the components of a relatively permanent shelter (shown as a housing unit 382). Housing unit 382 may be useful in situations of generally continuous radiation exposure, and where users would need to stay for long periods. System 310*a* is shown in a roof 384 to attenuate ambient radiation or radiation from the atmosphere. System 310*a* may be incorporated into an architectural or construction structure or article such as a wall panel or board 386 or a floor 388. System 310*a* may be incorporated into an article of furniture such as a partition wall, which may be collapsible (e.g. accordion style folding), or floor covering (shown as a carpet 390) above a basement 380. According to an alternative embodiment, the radiation attenuation system may also be combined with a construction element, such as a concrete floor or wall, a wood board or panel, etc. to "line" the construction elements of the building. According to another alternative embodiment, the radiation attenuation system may be used in the insulation of buildings (e.g. to attenuate radon "gas").

Figure 7:
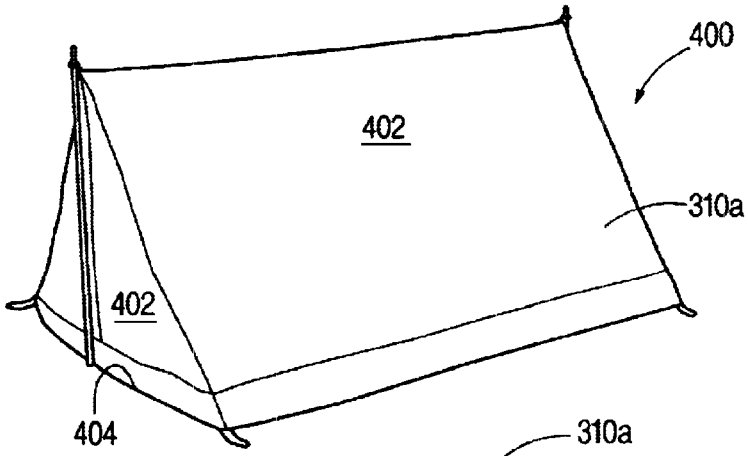
FIG. 7 is a perspective view of a shelter according to another exemplary embodiment.

As shown in FIG. 7, radiation attenuation system 310*a* may be incorporated into the components of a relatively temporary shelter (shown as a tent 400). Tent 400 may be useful in situations of generally temporary radiation exposure such as an area where there has been an atomic or nuclear explosion or accident. Wall 402 and floor 404 of tent 400 may be lined with system 310*a* to substantially shield the occupant from radiation. According to an alternative embodiment, the radiation attenuation system may be attached to a more permanent shelter such as a temporary building, housing unit or work environment.

Figure 8:
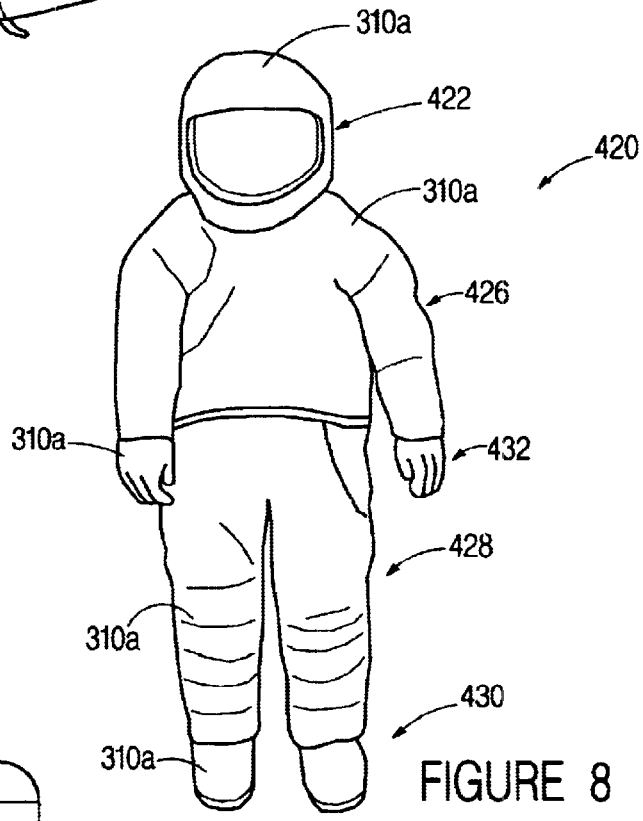
FIG. 8 is a schematic view of a radiation attenuation system according to another exemplary embodiment.

As shown in FIG. 8, radiation attenuation system 310*a* may be incorporated into a garment or article of clothing. The article of clothing may be useful in situations of generally temporary radiation exposure such as an area where there has been an atomic or nuclear explosion or accident, health care areas, etc. The article of clothing could extend the work time of the user in an area, and provide a relatively suitable level of protection against radiation. The article of clothing could also be useful by space travelers working in space exploration to attenuate electromagnetic radiation from outer space. This could be in the form of radiation protection clothing or other radiation protection system forms. As shown in FIG. 8, the article of clothing (shown as a suit 420) includes a head cover 422 (e.g. hood, hat, mask, eye protector, glasses, goggles, etc.), a body cover 426 (e.g. coat, jacket, tunic, shirt), a leg cover 428 (e.g. leggings, pants, coveralls, bibs, etc.), a foot cover 430 (e.g. shoes, shoe cover, boot, etc.) and a hand cover 432 (e.g. gloves, mittens, etc.) each incorporating radiation attenuation system 310*a*.

Figure 9A:
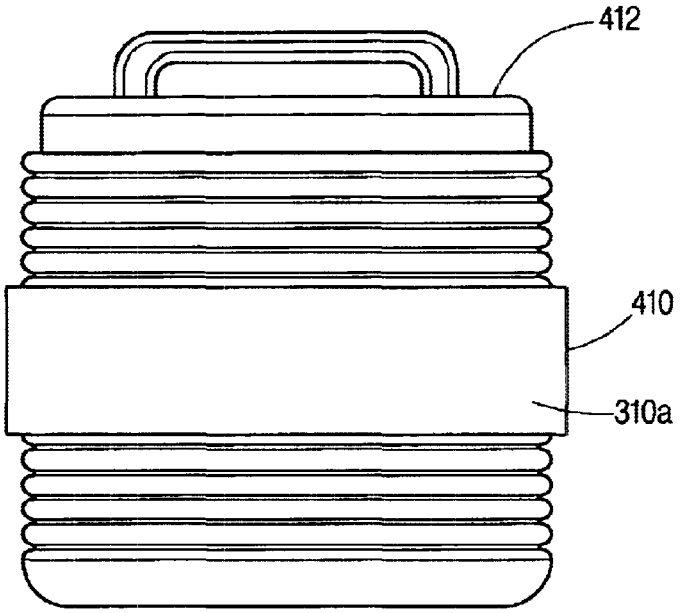
FIG. 9A is a perspective view of a radiation attenuation system according to another exemplary embodiment.

As shown in FIG. 9A, radiation attenuation system 310*a* may be incorporated in a sheet of material (shown as a blanket 410). Blanket 410 is shown wrapped around a storage container or water cooler 412 (e.g. in a work environment such as a nuclear reactor plant or atomic/nuclear waste management sites) to attenuate relatively low level radiation. According to an alternative embodiment, the blanket could be used as a "space blanket" to cover areas emitting radiation at relatively low levels. According to other alternative embodiments, the blanket could be used as a part of the walls or wall partitions that typically protect workers who are outside a workspace (e.g. medical cath lab, special procedures lab, etc.). According to other alternative embodiments, the blanket could be used to cover equipment or personnel during space travel and to attenuate electromagnetic radiation from outer space.

According to an alternative embodiment, the blanket may be a full drape, so that a worker (e.g. physician or technologist) could relatively quickly and easily roll out the drape and the radiation protection would already be in place (i.e. web could be a part of the entire drape). According to other alternative embodiments, the radiation attenuation system (i.e. web of radiation attenuation material) may be incorporated in a drape of the following types: angiography, femoral angiography, pain management, general or specialized biopsy, TIPS/IJ, dialysis shunt implant, pacemaker implant, radium implant, vascular surgery, etc. According to an alternative embodiment, a femoral angiography shield may have a length greater than its width (e.g. corresponding to a leg), and may include a relatively long aperture for access to the area of interest (e.g. femoral artery). According to still other alternative embodiments, the radiation attenuation system or the web may replace the plastic or fluid impervious layer in conventional drapes such as model No. 44207-0 or 48433-0 "Universal" angiography drapes commercially from Deka Medical, Inc. of Tyler, Tex.

Figure 9B:
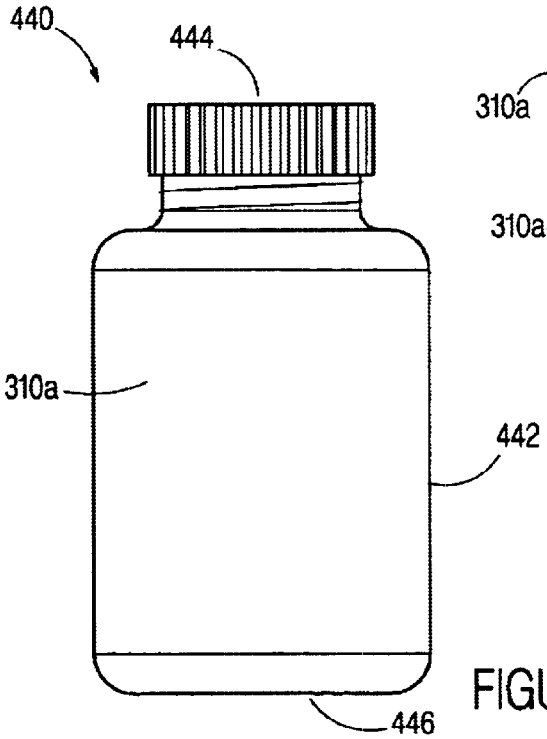
FIG. 9B is a perspective view of another radiation attenuation system according to another alternative embodiment.

As shown in FIG. 9B, radiation attenuation system 310*a* may be incorporated into a generally rigid container 440. Container 440 may be useful for housing and attenuating radiation from relatively high energy radiopharmaceuticals (e.g. radioactive seeds or implants) that may be used in nuclear medicine procedures (e.g. treatment of brain tumors). Container 440 includes a circular wall 442 (which may be threaded) between a removable cover or cap 444 and a fixed base 446.

The radiation attenuation system may be used in medical applications by physicians and other healthcare workers (e.g. interventional cardiologists and radiologists, pain management physicians, radiation therapy/oncologists, electophysiologists, etc.) who may work with fluoroscopy or in nuclear medicine. The radiation attenuation system (i.e. the web of having the attenuation material) may be configured and incorporated in any number of convenient shapes and sizes such as: radiation protection pads, thyroid shields, male gonadal shields, female gonadal shields, diapers, aprons (including miniaprons), breast shields, scoliosis shields, gloves, eye disks, barriers, and infant stabilization/shield members, shields, markers, table pads and density wedges. Such articles may be relatively easily trimmed to shape or fit to the extent necessary or desirable. Exemplary articles of the radiation attenuation shield are shown in FIGS. 10A through FIG. 10Y.

Figure 10A:
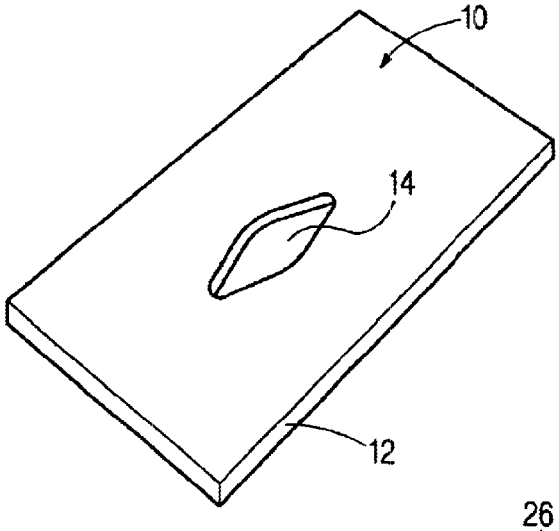
FIG. 10A is a perspective view of a radiation attenuation pad according to an exemplary embodiment.

FIG. 10A shows a radiation pad 10. Pad 10 is comprised of a panel 12 shown in the form of a rectilinear slab. Pads such as the radiation pad 10 are typically placed over an area of a user (e.g. patient) to be examined with a central cut or tapered aperture 14 defining the region within which the worker (e.g. examiner) will be working on the user. Aperture 14 may be placed coincident with the primary x-ray beam. The tapering presents a convenient field within which to work and to provide an edge, which will reside closely in contact with the body of the user. The radiation attenuating material from which the web is intended to at least partially attenuate radiation near the worker (e.g. physician) as he works on a patient. Such shields assist in the protection of the hands, arms, face and eyes of the worker when working close to a primary x-ray beam, preventing such debilitating or unwanted effects as the development of radiation-induced arthritis, dermatitis or hair loss. This can be a consideration whether the radiation is associated with a mammography, having a primary beam less than about 20 kVp as is for relatively high energy, and relatively high resolution work with beams over about 120 kVp. Further, in some nuclear medicine applications, medical workers may require a radiation attenuation system that can attenuate gamma rays and radiation levels of at least about 140 keV. Shields can be tailored for use throughout this energy range and are conveniently adaptable for use beyond it.

Figure 10B:
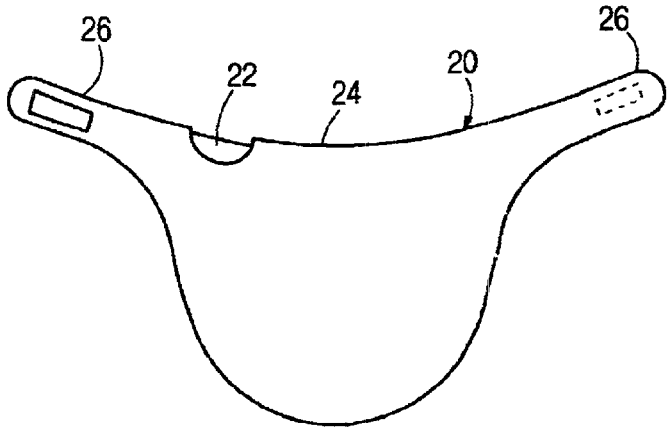
FIG. 10B is a plan view of a thyroid shield according to an exemplary embodiment.

FIG. 10B shows a thyroid shield 20. Shield 20 may be comprised of a body of radiation attenuating material 22 bearing a cloth or other type of covering 24 to improve comfort. The thyroid shield includes opposed ends 26, which provide an attachment member, such as that known as Velcro, to facilitate attachment of the thyroid shield to a user (e.g. patient).

Figure 10C:
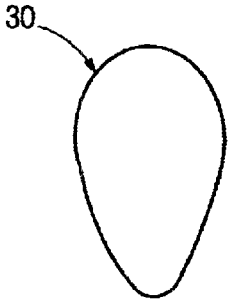
FIG. 10C is a plan view of male gonadal shield according to an exemplary embodiment.
Figure 10D:
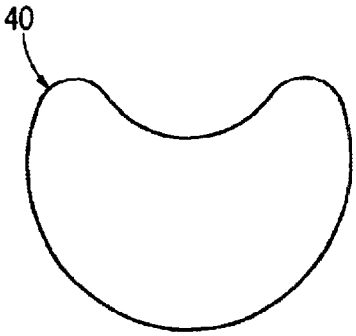
FIG. 10D is a plan view of a female gonadal shield according to an exemplary embodiment.

FIGS. 10C and 10D illustrate male and female gonadal shields 30 and 40 (respectively). These shields are configured to protect the gonadal region of a user (e.g. patient) during a radiological procedure.

Figure 10E:
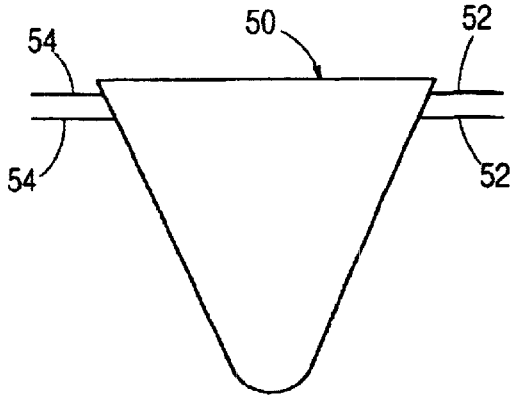
FIG. 10E is a plan view of a diaper according to an exemplary embodiment.

FIG. 10E is a view of a diaper 50 having a fastener 52 and 54 at opposed upper edges to facilitate the disposition of such a diaper about a user (e.g. patient). Diaper 50 may be made in a range of sizes to fit adult or adolescent patients as well as infants, to protect the gonadal and abdominal regions of the patient during a radiological procedure.

Figure 10F:
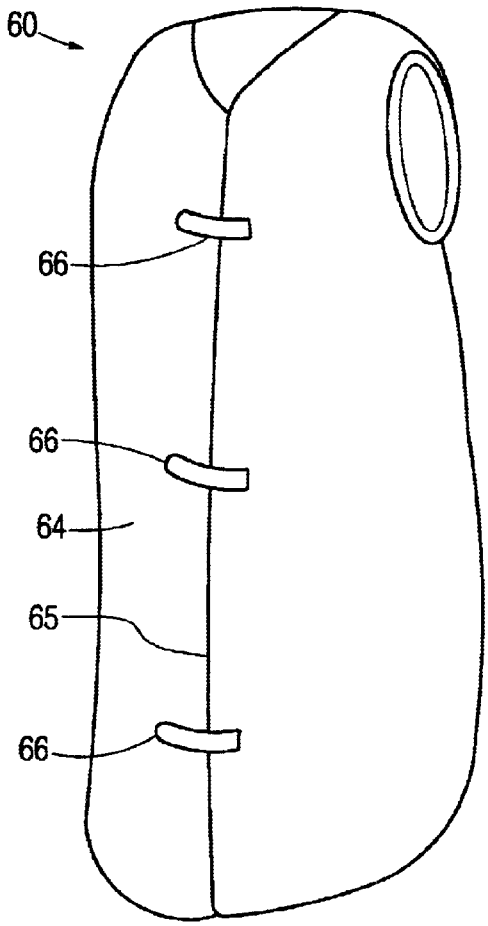
FIG. 10F is a perspective view of a wrap around protective apron configured for full torso protection according to an exemplary embodiment.
Figure 10G:
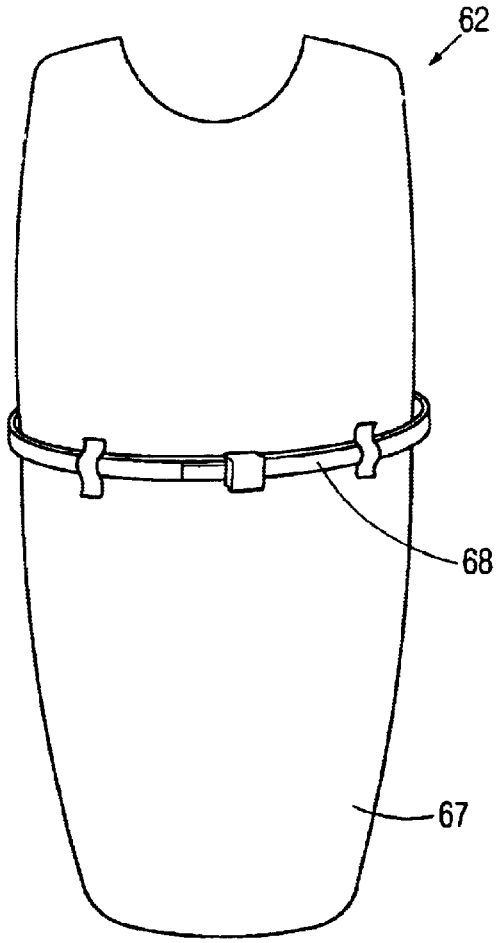
FIG. 10G is a perspective view of a front shield protective apron configured for full torso protection according to an exemplary embodiment.

FIGS. 10F and 10G show full torso protective aprons designated 60 and 62, respectively. Torso apron 60 is comprised of an enveloping shroud or apron 64 that encircles the front and back of the body of the wearer. Opposed marginal edges meet at a juncture 65, which is secured by fasteners 66. If desired, the body of apron 60 may be covered with a cloth, cloth-like material, or other types of material to improve wearer comfort and to place and secure fasteners 66. Body panel 67 of apron 62 drapes only the frontal portion of the wearer. In this instance, apron 62 does not surround the torso. It is secured to the wearer by ties or straps 68 encircling the waist region.

Figure 10H:
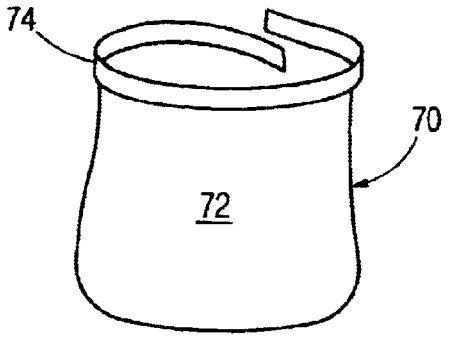
FIG. 10H is a side elevation view of a miniapron configured for partial torso protection according to an exemplary embodiment.
Figure 10K:
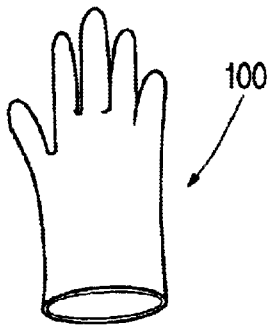
FIG. 10K is a perspective view of a glove according to an exemplary embodiment.

A miniapron 70 is shown in FIG. 10H. Miniapron 70 is comprised of a body or panel region 72 suspended from the waist of a wearer by ties or a fastening member 74. Miniapron 70 covers only a portion of the lower torso of the wearer. The apron designs of FIGS. 10F and 10G and 10H are configured to provide both examiner/patient comfort and examiner/patient safety in connection with radiological procedures or other exposure to sources of radiation.

Figure 10I:
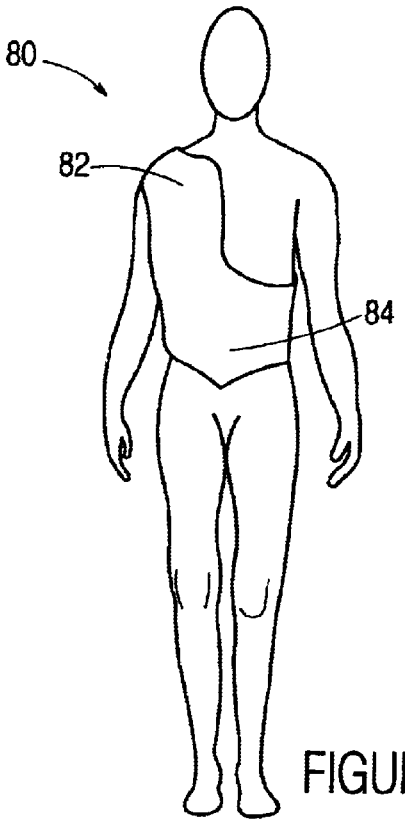
FIG. 10I is an anterior view of a female patient shown wearing a breast shield according to an exemplary embodiment.

FIG. 10I shows a breast protective barrier drape or shield 80 worn by a user (e.g. female patient), for example during a mammographic x-ray procedure. Breast shield 80 is thus comprised of an upper shield 82 which protects the portion of the anatomy of the user that is not subjected to examination, and shield 82 extends downwardly from the body of the user (e.g. from the shoulder toward the abdomen). A further shielding element 84 is provided about the gonadal region of the user (e.g. patient) to protect those organs as well. Accordingly, only the area to be examined is presented for irradiation while surrounding regions are protected against unwanted exposure.

Figure 10J:
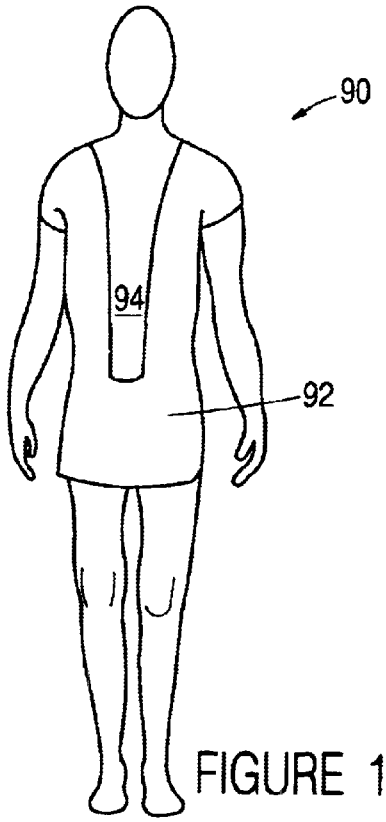
FIG. 10J is an anterior view of a male patient wearing a scoliosis shield according to an exemplary embodiment.

FIG. 10J shows a scoliosis shield 90. Shield 90 drapes from the shoulder region of the user (e.g. patient) to the lower abdomen. Shield 90 further includes a gonadal shield 92. The scoliosis shield leaves an exposed region 94 for examination.

FIG. 10K shows a protective glove designated generally as 100 fabricated from radiation shielding material. Glove 100 may be used by a health care practitioner when manipulating instruments or tools proximate a primary beam or in a region of secondary or scattered radiation; it may be worn by a user (e.g. patient) to protect his or her hand during examination of the body of the user in regions next to such a radiation source; or the glove may be worn by an individual who is required to handle sources of radioactive material.

Figure 10L:
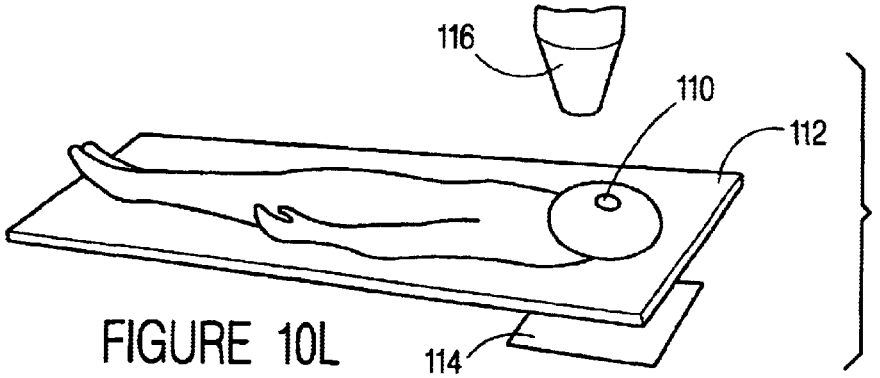
FIG. 10L is a perspective view of a patient undergoing radiological treatment about the head and neck of the patient, and is shown wearing an eye disc according to an exemplary embodiment.

FIG. 10L shows a perspective view of a user (e.g. patient) wearing a protective eye disc 110. The user is shown supported on an examination table 112 above a photographic plate 114, positioned for irradiation by an x-ray tube 116 to provide an x-ray image of the head and/or neck region of the user. In this instance, the eye protection assists in safeguarding the optical anatomy of the user from unwanted or undesirable exposure to the primary beam. The shield may also be useful in "tanning rooms."

Figure 10M:
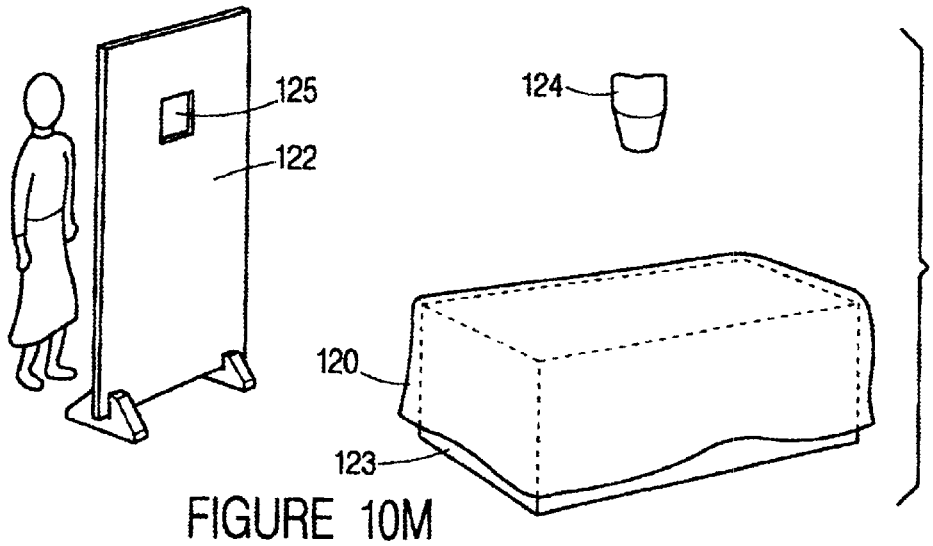
FIG. 10M is a perspective view of a barrier according to an exemplary embodiment.

FIG. 10M shows protective barriers and shields 120 and 122 used to protect personnel in an x-ray examination room or the like. In this instance, barrier 120 is associated with an examination table 123 placed beneath the tube of an x-ray machine 124. When a user (e.g. patient) is examined on table 123, drape or shield 120 confines scattered radiation from beneath the table. Also, during fluoroscopic procedures with the x-ray tube underneath the table, the drape or shield 120 could confine the scattered radiation underneath the table and attenuate radiation to at least partially protect the examining attendant and patient. Shield 120 may envelop the entirety of examination table 123 or be placed only on the side or sides toward which the examining attendant faces. This may be in a form similar to a "table skirt" that extends to the floor. Barrier 122 protects that attendant, as also shown in FIG. 10M, as well. In this case, the shield is formed with a cut-out or visually transparent component 125 through which the worker (e.g. examiner) may observe the patient. A certain amount of radiation may be transmitted through region 125.

Barriers of the sort shown in FIG. 10M can be of assistance in establishing either remote or temporary x-ray facilities. Most x-ray rooms include lead lining in or on the walls to confine radiation and prevent stray radiation from leaving the region of the x-ray apparatus. It is not always convenient or desirable to provide that type of lead-circumscribed environment, in which case protective barriers are capable of providing temporary but nonetheless relatively efficient shielding. Barriers of the sort shown in FIG. 10M, but modified appropriately, may also be useful in space travel to line the walls of a space vehicle or space station to attenuate electromagnetic radiation from outer space.

Figure 10N:
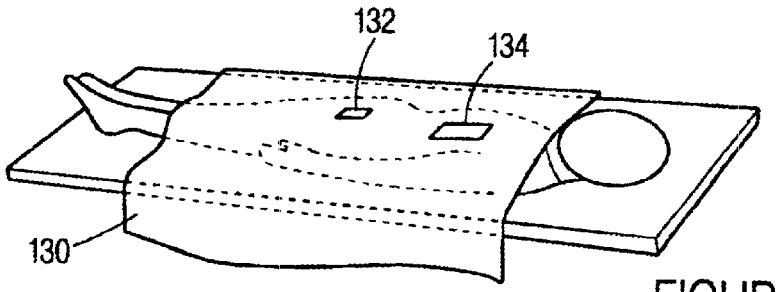
FIGS. 10N and 10O are schematic views of a drape showing the drape disposed over a patient in preparation for a cardiac catheterization procedure according to an exemplary embodiment.
Figure 10O:
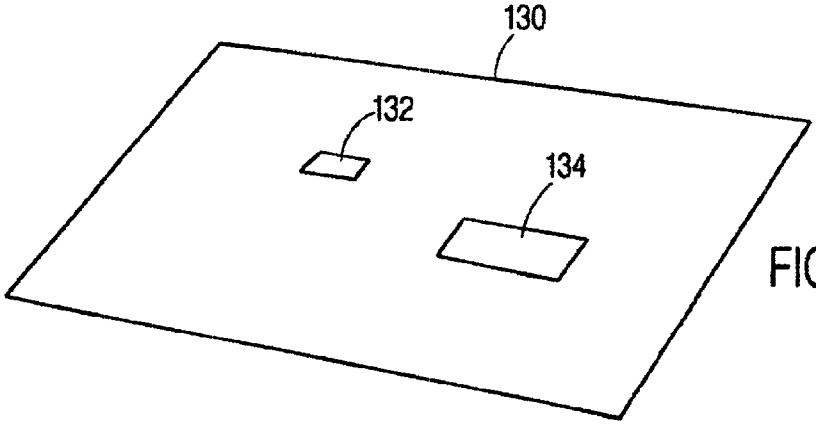

FIGS. 10N and 10O show a protective drape, in this instance configured for a cardiac catheterization procedure to be performed on a user (e.g. patient). A protective drape 130, is sized to cover the user essentially over the majority of the body, being draped from the upper chest region to the lower legs as best viewed in FIG. 10N. Drape 130 could be of sufficient width to span entirely across the user (e.g. patient) and the operating table. Drape 130 is fabricated from radiation shield. A first keyway or cut-out 132 is formed in the upper thigh region while a panel or window 134 of neutral material is provided in the drape in the region of the heart of the user. The cut-out provides the worker (e.g. physician) with an entry point to insert a needle or through which to introduce the catheter instrumentation. The patient is subjected to x-ray radiation passing through the region of window 134. Watching an appropriate display responsive to that radiation, the worker may manipulate the catheter from the region of cut-out 132 into proper position proximate the heart. During that procedure, however, protective drape 130 at least partially protects operating room personnel from scattered radiation.

The compliant nature of drape 130 allows it to reside closely next to the body of the patient. It is comfortable and fits positively against the undulating surface of the patient, thus improving its stability while the surgical team is operating on the body of the patient. The coefficient of friction between the drape and the skin of the patient adds to that stability, preventing movement of the drape during the surgical procedure and further obviating the need to take extraordinary measures to prevent slippage or movement of the drape.

Figure 10P:
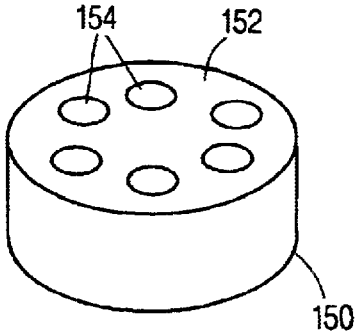
FIG. 10P is a perspective view of a radionuclide transportation and/or storage device according to an exemplary embodiment.
Figure 10R:
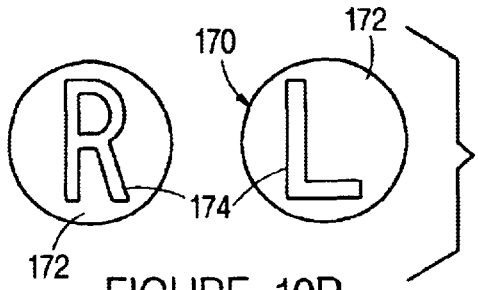
FIGS. 10R and 10S are plan views of film markers according to an exemplary embodiment.
Figure 10S:
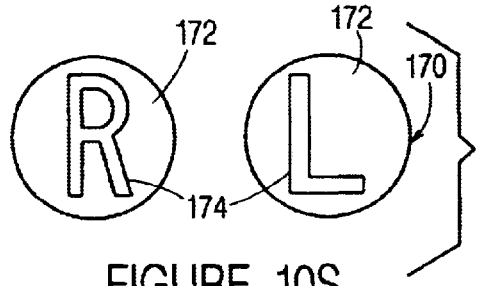

FIG. 10P shows a radionuclide transportation and storage article or device 150. In this instance, device 150 is comprised of a body of radiation attenuating material having a plurality of blind apertures 154 formed therein. Each of the apertures 154 is dimensioned to receive a vial of radioactive material to be transported and/or stored (e.g. material used in radiation treatment in a hospital). Each of blind apertures 154 may be slightly undersized to ensure a close interference fit between body 152 and the vials to be inserted in those apertures. Once in place, a cover of similar material may be disposed over device 150 and secured in any convenient manner for transport and/or storage.

Figure 10Q:
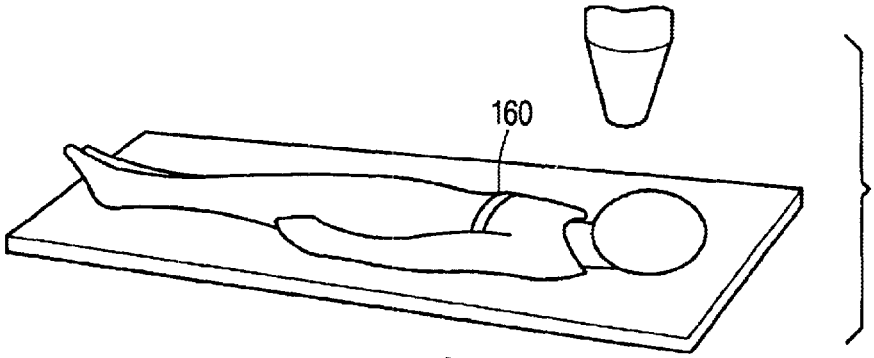
FIG. 10Q is a perspective view of a patient undergoing radiation treatment and/or examination and wearing a marker according to an exemplary embodiment.

FIG. 10Q shows a marker 160 placed on a user (e.g. patient) undergoing radiological examination. Marker 160 is positioned at a specific location on the body of the patient to provide a benchmark for measurement on the image resulting from the x-ray procedure. Thus, being radiopaque, a mark will appear either on an x-ray film or on a real time display permitting a worker (e.g. physician) to measure with reasonable precision the location of internal anatomy from that known point as evidenced by the marker.

FIGS. 10R and 10S show film markers such as have been used in the past to identify x-ray films. In each case, a marker 170 is comprised of a support 172 bearing a letter indicia 174 either as an "R" or as an "L." These indicia are meant to identify radiographic representations as either the right or left part or extremity of some anatomical element or, if the object being examined is not a patient but an inanimate object, other markers of similar variety may be used to identify specific locations or characteristics. Typically, the support will be radio-transmissive whereas the indicia will be radiopaque. Where such markers are utilized with patients in x-ray examination and especially where the marker is placed in contact with the patient, the marker may then be disposed.

Figure 10T:
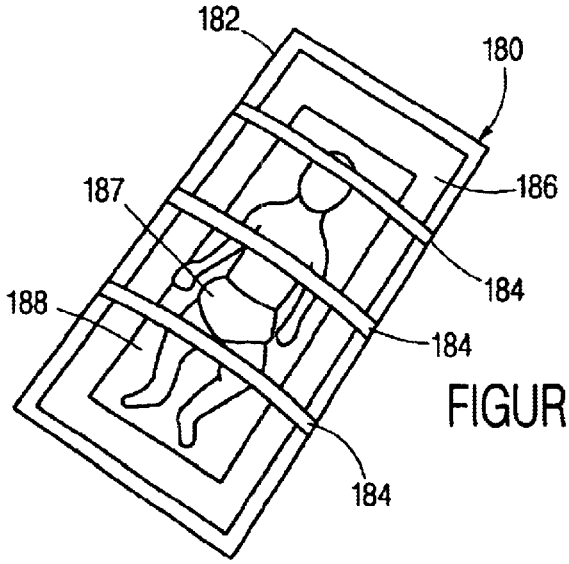
FIG. 10T is a top plan view of an infant stabilization device incorporating protective radiation shields according to an exemplary embodiment.

FIG. 10T shows an infant stabilization device including a protective radiological shield 180. Shield 180 includes a frame 182 having a plurality of straps 184 (or the like) for restraining the infant in position on the stabilization member. A border 186 of radiation attenuating material is disposed peripherally about the stabilization member while the infant may be provided with a diaper 187 likewise made from radiation attenuating material in accordance with the present invention. A cut-out region 188 is provided to allow x-ray examination of the infant or a selected portion of his anatomy. Typically, the infant is placed on the pad and is strapped into position with his hands suitably secured. With shielding in place, a holder such as the parent of the infant (also suitably protected) may assist in the x-ray procedure as required.

Figure 10U:
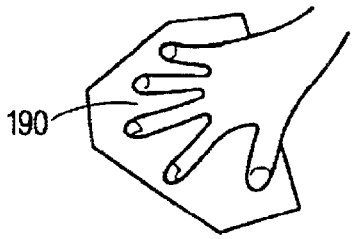
FIGS. 10U, 10V and 10W are schematic views showing a variety of patient positioning devices according to an exemplary embodiment.
Figure 10V:
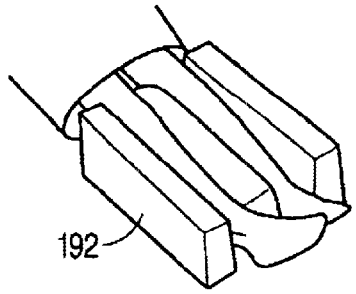
Figure 10W:
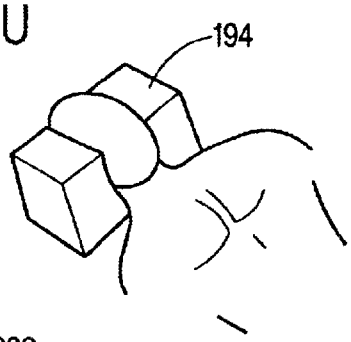

FIGS. 10U, 10V and 10W show different forms of patient positioning devices used in radiological procedures, either investigative or therapeutic. In FIG. 10U, the hand of a patient is positioned on a positioning device 190; in FIG. 10V, the leg of the patient is confined within a positioning device 192; and in FIG. 10W, the head of the patient is suitably positioned within a device 194.

Figure 10X:
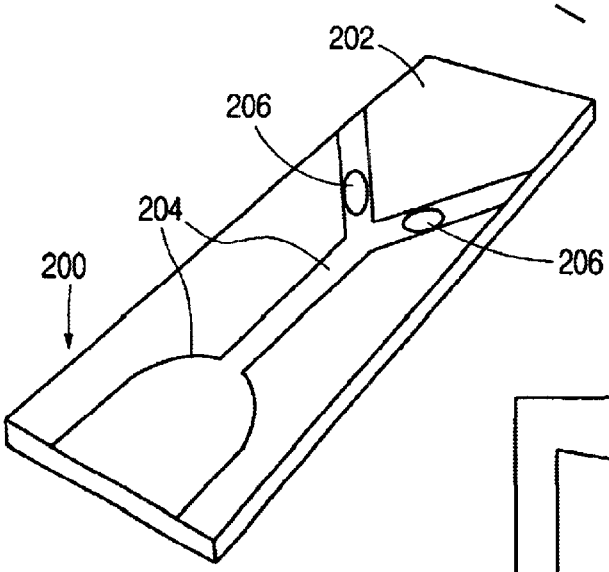
FIG. 10X is a perspective view of a fluoroscopy table pad adapted for angiography according to an exemplary embodiment.
Figure 10Y:
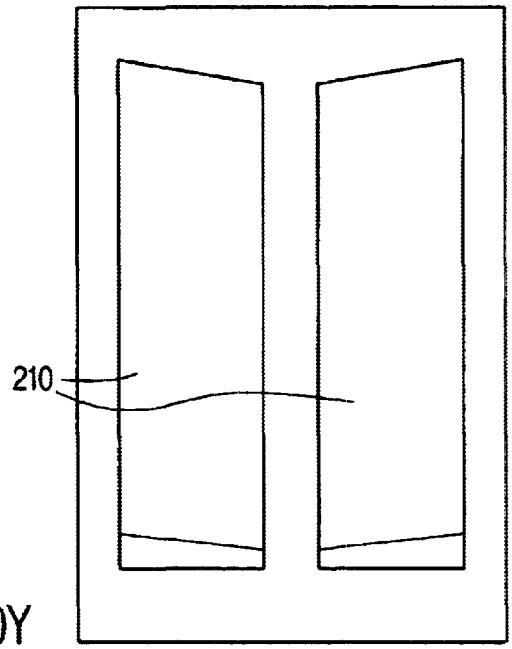
FIG. 10Y is a top plan view of a density wedge according to an exemplary embodiment.

FIG. 10X shows a fluoroscopic table pad 200. Table pad 200 is of a generally rectilinear configuration, shaped as a web 202 fabricated from a one-quarter inch to one-half inch slab of radiation attenuating material in accordance with the present invention. Zones of neutral material 204 are formed in the pad 200, here disposed in shape and size as required for angiography. Cut-outs 206 in the pad allow items to be inserted through the pad as may be required. The pad is placed on the table beneath a patient undergoing angiography, during which he is subjected to x-ray radiation from beneath the table. The primary beam is allowed to pass through the pad only in the regions of the neutral material 204.

FIG. 10Y shows a pair of density wedges 210. Each of wedges 210 is tapered and thus provides higher density radiopacity at the thicker edge than at the thinner or tapered edge.

According to alternative embodiments, the radiation attenuation system may be used in space travel or shelter (e.g. space station or vehicle) applications. Specifically, the system may substantially protect humans or sensitive cargo from radiation that could be present in outer space. According to other alternative embodiments, the radiation attenuation system may have applications in the medical, industrial, clothing, architectural (e.g. furnishings and wall coverings), packaging and shipping containers (e.g. food, electronics, etc.), construction materials, geotextiles, and vehicular (automotive, boating, airplane, exterior and interior) industries.

According to a preferred embodiment, the radiation attenuation system is generally disposable in whole or in part, thereby minimizing ancillary sources of contamination that may arise from multiple uses. According to another suitable embodiment, the radiation attenuation system is generally non-toxic, recyclable, and/or biodegradable. According to an alternative embodiment, the radiation attenuation system may be reusable (e.g. for attenuation of radiation from atomic/nuclear disaster, clean up, rescue operations, etc.). According to a preferred embodiment, the radiation attenuation system may be sterilized between uses to minimize the likelihood of bacteriological or virus contamination. Sterilization may be performed in any convenient manner, including gas sterilization and irradiation sterilization.

The "durometer" is a suitable measure of the drape and hand of the radiation attenuation system. For certain applications such as a medical drape, the durometer of the system is suitably less than about 100 Shore "00, " suitably about 5–80 Shore "00", suitably about 15–40 Shore "00. " Shore "00"may be measured on a Shore durometer commercially available from Shore Manufacturing Company of Jamaica, N.Y. The selection of materials for the radiation attenuation system that yield an appropriate softness (which manifests itself in terms of hand and drape viewed in the apparel context) provides a material that is relatively conformable to the body (e.g. patient) or article shrouded.

The "coefficient of sliding friction" (determined as the tangent of the angle of inclination to induce sliding) relative to the body (e.g. patient) or article shrouded is a suitable measure of the friction provided by the radiation attenuation system. The coefficient of friction between the radiation attenuation system and the skin of the user (e.g. patient) may add stability, thereby preventing movement of the radiation attenuation system during use (e.g. the surgical procedure) and further obviating the need to take extraordinary measures to prevent slippage or movement of the radiation attenuation system.

The coefficient of sliding friction of the radiation attenuation system is suitably sufficient to maximize the placement stability of the radiation attenuation system when in use, and is sufficiently great enough so that the radiation attenuation system cannot be easily dislodged or moved after placement for certain applications. For other certain applications such as a medical drape, the coefficient of sliding friction of the radiation attenuation system is suitably at least about 0.15, suitably at least about 0.5, suitably at least about 0.75, suitably at least about 1.0. For specific applications such as a surgical drape or protective shield for direct contact with a user (e.g. patient), the coefficient of sliding friction of the radiation attenuation system is suitably at least about 2.0.

Figure 12:
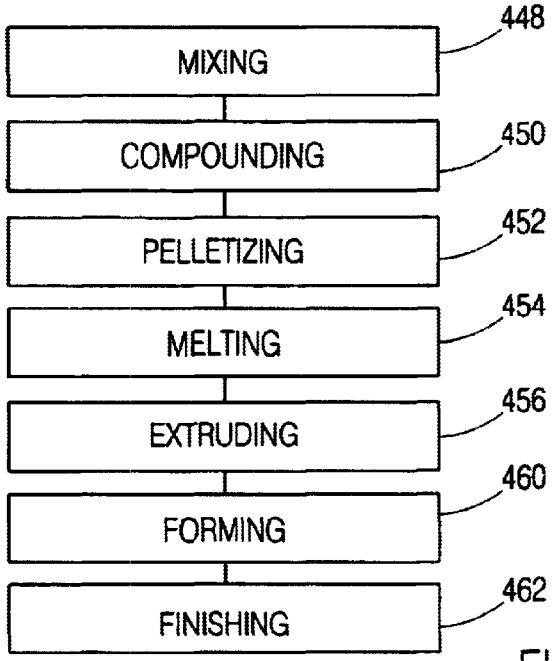
FIG. 12 is a block diagram of a method of making a radiation attenuation system according to an exemplary embodiment.
Figure 13:
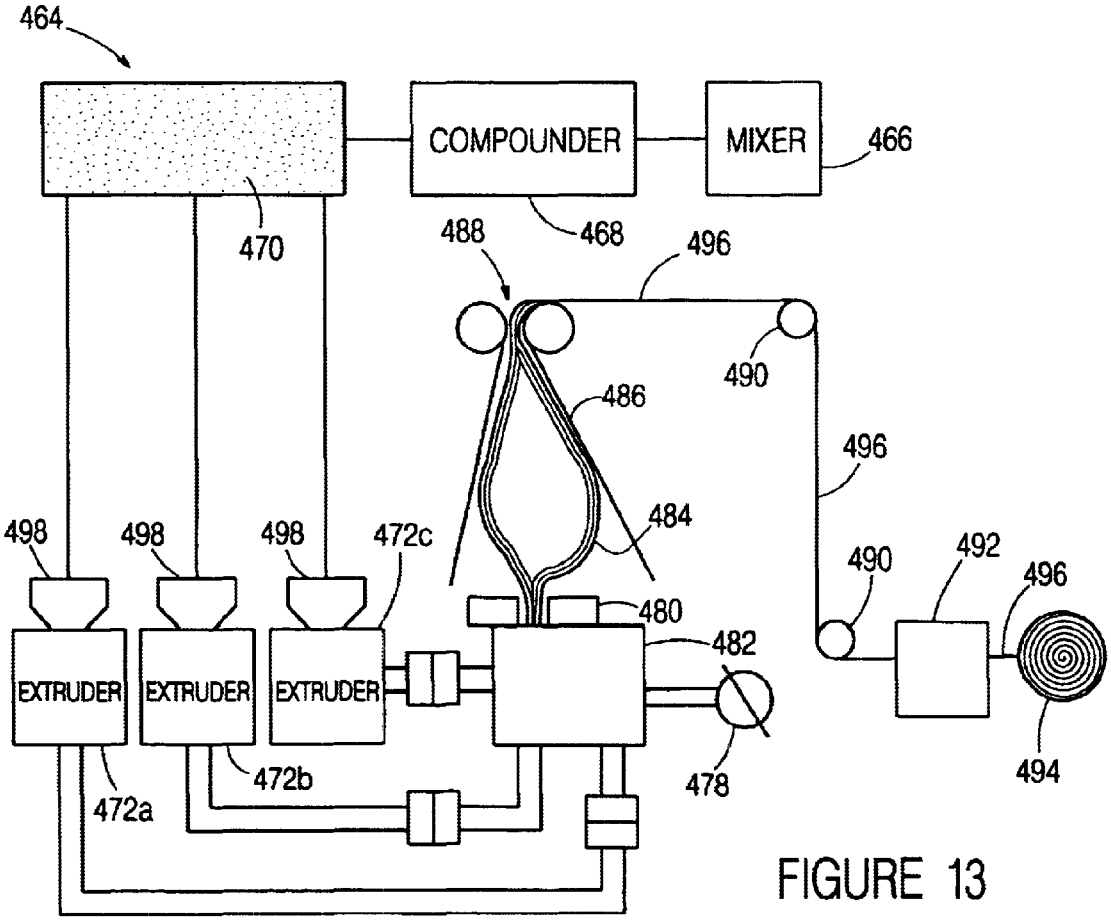
FIG. 13 is a schematic view of an apparatus for making a radiation attenuation system according to an exemplary embodiment.

FIG. 12 shows exemplary process steps for making the radiation attenuation system according to a three layer coextrusion blown film polymer process method. (According to an exemplary embodiment as shown in FIG. 13, three extruders may be used to manufacture an "ABA" or three layer structure, with each "A" layer being a skin layer and the "B" or intermediate layer being a radiation attenuation layer.) FIG. 13 shows an apparatus 464 for manufacturing an exemplary radiation attenuation system.

Referring to FIGS. 12 and 13, the radiation attenuation material (i.e. powder) is mixed (step 448) in a blender or mixer 466, and then compounded (step 450) in a compounder 468 (such as a twin screw extruder) and then "pelletized" or cut into attenuation pieces or pellets 470 (step 452). Pellets 470 are fed into a hopper 498 and melted (step 454) e.g. in a melt process. The resulting melt may be pumped or extruded (step 456) from an extruder (shown as extruders 472*a*, 472*b* and 472*c*) through a forming die 482. The resulting extrusion is formed (e.g. "blown," inflated or filled with air) (step 460) to produce an extrusion or "bubble" 484. Each of the extrusions from each of extruders 472*a*, 472*b* and 472*c* can provide a layer of material to bubble 484. (Three layers of bubble 484 are shown in FIG. 13. According to an alternative embodiment, one or more layers may be formed according to the number of layers desired in the bubble.) An air ring 480 may blow cooled or chilled air to cool and stabilize bubble 484 (step 460). As shown in FIG. 13, an air valve 478 may manipulate the air. According to alternative embodiments, the bubble may be of a variety of shapes such as a film, sheet, bottle, etc. depending on the application.

Bubble 484 may be pulled by a nip 488, and collapsed by a wall or frame 486 to form a sheet of a relatively flat web 496 (step 462). Web 496 may travel through a set of nips and a number idler rolls 490. According to alternative embodiments, the web may be further processed (e.g. lamination, die cut, finishing, etc.) depending on the application. According to another alternative embodiment as shown in FIG. 13, web 496 may be corona treated by a corona device 492 depending on the final application. Web 496 may be wound in a roll 494 for storage or shipping.

According to alternative embodiments, the radiation attenuation system may be made according to a variety of polymer process methods, including but not limit to, cast film/sheet process, tubular blown film process, cast sheeting process, sheet calendaring, fiber spinning, blow molding, injection molding, rotational molding, foam process and compression, transfer molding, profile extrusion and coextrusion, non-woven process, etc.

The radiation attenuation percent (%) of an incident direct radiation beam by a radiation attenuation system was measured. For EXAMPLES 1–3, the results were obtained with a Keithley 35050A Dosimeter with a 15 cc chamber commercially available from Keithley Instruments, Inc. Radiation Measurements Division of Solon, Ohio.

EXAMPLE 1

A radiation attenuation sample was prepared. The sample included a radiation attenuation material of bismuth oxide powder commercially available from ASARCO Incorporated of New York, N.Y. and barium sulfate powder commercially available from Mountain Minerals Co. Ltd. of Calgary, Alberta, Canada and having a weight ratio of 22:78. The resin was a model no. PE 1031 low density polyethylene resin (commercially available from Huntsman Corporation of Salt Lake City, Utah) having a density of 0.924 gram per cubic centimeter and a melt index of 0.8 gram per 10 minutes. The weight of the radiation attenuation material to resin polymer material was about 2.3:1. The volume of the radiation attenuation material to resin polymer material was about 1:4.

The sample was die cut into three pieces resulting in Samples 1, 2 and 3. Sample 1 was one layer of the die cut sample. Sample 2 was two layers of the die cut sample (one piece on top of the other). Sample 3 was three layers of the die cut sample (each piece on top of the other). The radiation attenuation percent of the Samples are shown in TABLE 1.

TABLE 1

| | | 70 kVp; HVL = 2.63 mm Al | | 90 kVp; HVL = 3.41 mm Al | | 110 kVp; HVL = 4.31 mm Al | |
|---|---|---|---|---|---|---|---|
| Sample | Thickness (mm) | Attenuation (%) | Pb equivalent (in mm) | Attenuation (%) | Pb equivalent (in mm) | Attenuation (%) | Pb equivalent (in mm) |
| 1 | <0.1 | 8.86 | 0.001 | 7.35 | 0.002 | 6.52 | 0.0025 |
| 2 | <0.1 | 16.20 | 0.002 | 13.68 | 0.003 | 11.97 | 0.0040 |
| 3 | 0.1 | 21.39 | 0.0035 | 18.10 | 0.005 | 16.02 | 0.005 |

EXAMPLE 2

A radiation attenuation sample was prepared. The sample included a radiation attenuation material of bismuth powder commercially available from ASARCO Incorporated of New York, N.Y. and barium sulfate powder commercially available from Mountain Minerals Co. Ltd. of Calgary, Alberta, Canada and having a weight ratio of 22:78. The resin was a model no. PE 1031 low density polyethylene resin (commercially available from Huntsman Corporation of Salt Lake City, Utah) having a density of 0.924 gram per cubic centimeter and a melt index of 0.8 gram per 10 minutes. The weight of the radiation attenuation material to resin polymer material was about 1:1. The volume of the radiation attenuation material to resin polymer material was about 1:9.

The sample was die cut into three pieces resulting in Samples 1, 2 an 3. Sample 1 was one layer of the die cut sample. Sample 2 was two layers of the die cut sample (one piece on top of the other). Sample 3 was three layers of the die cut sample (each piece on top of the other). The radiation attenuation percent of the Samples are shown in TABLE 2. At 90 kVp, Sample 1 had about a 10% attenuation factor, and Samples 2 and 3 had about a 20% and 30% attenuation factor (respectively). With the loading of attenuation materials in the samples, the effect was about 10% radiation blocking per layer of material. Higher levels of attenuation may be achieved as the compounding material loading is changed, and multiple layers of material are used.

TABLE 2

| | | 70 kVp; HVL = 2.63 mm Al | | 90 kVp; HVL = 3.41 mm Al | | 110 kVp; HVL = 4.31 mm Al | |
|---|---|---|---|---|---|---|---|
| Sample | Thickness (mm) | Attenuation (%) | Pb equivalent (in mm) | Attenuation (%) | Pb equivalent (in mm) | Attenuation (%) | Pb equivalent (in mm) |
| 1 | <0.1 | 11.93 | 0.001 | 10.59 | 0.003 | 9.61 | 0.003 |
| 2 | <0.1 | 22.46 | 0.004 | 20.24 | 0.007 | 18.43 | 0.007 |
| 3 | 0.1 | 32.99 | 0.008 | 29.72 | 0.012 | 27.08 | 0.013 |

EXAMPLE 3

A radiation attenuation sample was prepared. The sample included a radiation attenuation material of bismuth powder commercially available from ASARCO Incorporated of New York, N.Y. and barium sulfate powder commercially available from Mountain Minerals Co. Ltd. of Calgary, Alberta, Canada and having a weight ratio of 22:78. The resin was a model no. PE 1031 low density polyethylene resin (commercially available from Huntsman Corporation of Salt Lake City, Utah) having a density of 0.924 gram per cubic centimeter and a melt index of 0.8 gram per 10 minutes. The weight of the radiation attenuation material to resin polymer material was about 2.3:1. The volume of the radiation attenuation material to resin polymer material was about 1:4.

The sample was die cut into four pieces resulting in Samples 1, 2, 3 and 4. Sample 1 was one layer of the die cut sample. Sample 2 was two layers of the die cut sample (one piece on top of the other). Sample 3 was three layers of the die cut sample (each piece on top of the other). Sample 4 was four layers of the die cut sample (each piece on top of the other). The radiation attenuation percent of the Samples are shown in TABLE 3.

TABLE 3

| | | 70 kVp; HVL = 2.63 mm Al | | 90 kVp; HVL = 3.41 mm Al | | 110 kVp; HVL = 4.31 mm Al | |
|---|---|---|---|---|---|---|---|
| Sample | Thickness (mm) | Attenuation (%) | Pb equivalent (in mm) | Attenuation (%) | Pb equivalent (in mm) | Attenuation (%) | Pb equivalent (in mm) |
| 1 | <0.1 | 11.69 | 0.003 | 10.73 | 0.002 | 9.94 | 0.003 |
| 2 | <0.1 | 28.00 | 0.007 | 25.43 | 0.010 | 23.38 | 0.012 |

TABLE 3-continued

| | | 70 kVp; HVL = 2.63 mm Al | | 90 kVp; HVL = 3.41 mm Al | | 110 kVp; HVL = 4.31 mm Al | |
|---|---|---|---|---|---|---|---|
| Sample | Thickness (mm) | Attenuation (%) | Pb equivalent (in mm) | Attenuation (%) | Pb equivalent (in mm) | Attenuation (%) | Pb equivalent (in mm) |
| 3 | 0.1 | 47.93 | 0.017 | 43.83 | 0.025 | 40.38 | 0.027 |
| 4 | <0.2 | 58.45 | 0.030 | 53.55 | 0.037 | 49.63 | 0.040 |

The radiation system may at least partially "shield" or attenuate radiation from a gamma radiation source (e.g. gamma-ray). A gamma ray is believed to be made up of photons or small bits of light traveling as waves of energy. Gamma-rays are an example of relatively high energy photons, and are part of the electromagnetic spectrum. The energy carried by photons is typically measured in units of electron volts (eV). For example, visible light is made up of photons with energies of about 2 or 3 eV, and gamma-rays are photons of light with energies of 50,000 eV (50 keV) to 1,000,000,000,000 eV (1 TeV) or higher.

One measure of the shielding of gamma radiation is the attenuation coefficient of a material. The attenuation coefficient shows the ability of the material to "shield" or attenuate gamma rays of a particular energy. The attenuation coefficient may include the measure of the slope of the natural logarithm of the intensity of the gamma radiation plotted against the thickness of the material. Shielding may occur when incident radiation is either reflected or absorbed by a material. Linear density and composition of a material also may affect its ability to shield gamma radiation. The energy of the gamma ray may affect the amount and the means by which it is shielded. Relatively lower energy gamma rays are believed to undergo the photoelectric effect or Compton scattering, while higher energy photons are believed to collide with atoms to produce electron-positron pairs. Density (or ration of attenuation material to the carrier of the attenuation material) is also related to shielding ability.

The radiation attenuation fraction of a relatively high energy radiation beam by a radiation attenuation system may be measured as shown in prophetic EXAMPLE 4.

EXAMPLE 4

A radiation attenuation sample may be prepare prepared. The sample may include a radiation attenuation material of bismuth powder commercially available from ASARCO Incorporated of New York, N.Y. compounded in a polymer resin. The weight of the radiation attenuation material to polymer resin may be varied for each sample. Each sample may be tested against both Technetium-99 (with energy level of 140 keV) and Iodine-131 (with energy level of 365 keV) which emits gamma radiation. The attenuation fraction of each sample is shown in TABLE 4.

TABLE 4

| Sample | Thickness (mil) | Weight Ratio (bismuth: resin) | Technetium - 99 m (140 keV) Attenuation Fraction (Tc99m) | Iodine - 131 (365 keV) Attenuation Fraction (I131) |
|---|---|---|---|---|
| 1 | <300 | 1.83:1 | .86 | .41 |
| 2 | <300 | 1.73:1 | .73 | .32 |

TABLE 4-continued

| Sample | Thickness (mil) | Weight Ratio (bismuth: resin) | Technetium - 99 m (140 keV) Attenuation Fraction (Tc99m) | Iodine - 131 (365 keV) Attenuation Fraction (I131) |
|---|---|---|---|---|
| 3 | <300 | 1.17:1 | .66 | .29 |
| 4 | <300 | 1:1 | .49 | .25 |

The construction and arrangement of the elements of the radiation attenuation system as shown in the preferred and other exemplary embodiments is illustrative only. Although only a few embodiments of the present inventions have been described in detail in this disclosure, those skilled in the art who review this disclosure will readily appreciate that many modifications are possible (e.g. variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, the attenuation material may be embedded in the web. The radiation attenuation system may be of a variety of sizes (e.g. 125"×75", 32"×34", 32"×110", etc.). The web may be a relatively fluid impervious layer.

Accordingly, all such modifications are intended to be included within the scope of the present invention as defined in the appended claims. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the preferred and other exemplary embodiments without departing from the spirit of the present inventions as expressed in the appended claims.

What is claimed is:

1. A system for the attenuation of radiation comprising:

a polymeric resin comprising a web comprising a relatively thin membrane;

a radiation attenuation material dispersed at least partially in the resin;

wherein the system has a radiation transmission attenuation factor of at least about 10% of a primary 100 kVp x-ray beam.

2. The system of claim 1 wherein the web comprises a plurality of layers.

3. The system of claim 2 having a radiation transmission attenuation factor of at least about 50% of a primary 100 kVp x-ray beam.

4. The system of claim 2 having a gamma radiation attenuation fraction of at least about 10% of a 140 KeV radiation source.

5. The system of claim 2 wherein the web has a thickness of less than about 50 mil.

6. The system of claim 4 having a gamma radiation attenuation fraction of at least about 50% of a 140 KeV radiation source.

7. The system of claim 2 wherein the web is generally flexible.

8. The system of claim 5 wherein the web is generally rigid.

9. The system of claim 7 wherein the web comprises a film.

10. The system of claim 7 wherein the web comprises a plurality of fibers.

11. The system of claim 9 further comprising a cover coupled to the web.

12. The system of claim 11 wherein the cover comprises a skin.

13. The system of claim 9 wherein the resin comprises a plastic.

14. The system of claim 9 wherein the radiation attenuation material is substantially free of lead.

15. A method of making a radiation attenuation system having a radiation attenuation material dispersed at least partially in a polymeric resin comprising:

extruding the radiation attenuation material and the polymeric resin thereby forming an extrusion;

blowing the extrusion into a web comprising a relatively thin membrane;

wherein the web has a radiation transmission attenuation factor of at least about 10% of a primary 100 kVp x-ray beam.

16. The method of claim 15 wherein blowing the extrusion further comprises forming a sheet of film.

17. The method of claim 16 wherein extruding the radiation attenuation material and the polymeric resin further comprises forming a plurality of separate extrusions.

18. The method of claim 16 wherein blowing the extrusion further comprises inflating the web.

19. The method of claim 18 further comprising compounding the polymeric resin and the radiation attenuation material before extruding the radiation attenuation material and the polymeric resin.

20. A shield for the attenuation of radiation comprising:

a sheet comprising a radiation attenuation material dispersed generally evenly in a polymeric resin comprising:

a first film;

a second film coupled to the first film;

wherein a radiation transmission attenuation factor of the sheet is greater than a radiation transmission factor of at least one of the first film and the second film and the radiation transmission attenuation factor of the sheet is at least about 10% of a primary 100 kVp x-ray beam.

21. The shield of claim 20 wherein the sheet has a radiation transmission attenuation factor of at least 50% of a primary 100 kVp x-ray beam.

22. The shield of claim 20 wherein the sheet has a thickness of less than about 50 mil.

23. The shield of claim 20 wherein the sheet has a gamma radiation attenuation fraction of at least about 10% of a 140 KeV radiation source.

24. The shield of claim 22 further comprising a cover coupled to the sheet.

25. The system of claim 23 wherein the sheet has a gamma ray radiation attenuation fraction of at least about 50% of a 140 KeV radiation source.

26. The shield of claim 24 wherein the cover comprises a generally liquid impervious layer.

27. The shield of claim 24 wherein the cover further comprises an absorbent layer.

28. The shield of claim 24 wherein the cover comprises a construction article.

29. The shield of claim 24 wherein the cover comprises an article of clothing.

30. The shield of claim 24 wherein the cover comprises a blanket.

31. The shield of claim 24 wherein the resin comprises a fiber.

32. The shield of claim 24 wherein the sheet comprises a container.

33. The shield of claim 26 wherein the impervious layer comprises a polymeric material.

34. The system of claim 12 wherein the skin is laminated to the film.

35. The system of claim 13 wherein the radiation attenuation material is dispersed generally evenly in the resin.

36. The system of claim 13 wherein the weight of the radiation attenuation material is less than about ten times the weight of the resin.

37. The system of claim 13 wherein the volume of the resin is less than about five times the volume of the radiation attenuation material.

38. The system of claim 14 wherein the radiation attenuation material comprises at least one of barium and bismuth.

39. The system of claim 14 wherein the radiation attenuation material comprises a particle having a diameter of less than about 44 micron meters.

40. The system of claim 14 wherein the web has a thickness of less than about 10 mil.

41. The shield of claim 20 wherein the first film is laminated to second film.

42. The system of claim 22 wherein the web has a thickness of less than about 10 mil.

* * * * *